United States Patent [19]

Dutcher

[11] 4,197,979

[45] Apr. 15, 1980

[54] PARTITIONED CARTON

[75] Inventor: Daniel P. Dutcher, Woodbury, Minn.

[73] Assignee: Champion International Corporation, Stamford, Conn.

[21] Appl. No.: 884,615

[22] Filed: Mar. 8, 1978

[51] Int. Cl.[2] ..... B65D 5/48

[52] U.S. Cl. ..... 229/29 D; 229/15; 229/41 B; 229/27

[58] Field of Search ..... 229/27, 29 E, 28 R, 229/28 BC, 15, 29 D, 41 B

[56] References Cited

U.S. PATENT DOCUMENTS

| | | | |
|---|---|---|---|
| 2,747,767 | 5/1956 | Bergstein | 229/28 BC |
| 2,747,785 | 5/1956 | Fink | 229/28 BC |
| 3,184,143 | 5/1965 | Kotowick | 229/28 R |
| 3,334,801 | 8/1967 | Henderson | 229/28 R |
| 3,347,356 | 10/1967 | Kossnar | 229/27 |
| 3,941,302 | 3/1976 | Tyrseck | 229/27 |

FOREIGN PATENT DOCUMENTS

| | | | |
|---|---|---|---|
| 1208318 | 2/1958 | France | 229/28 R |
| 327954 | 3/1958 | Switzerland | 229/28 R |
| 1192032 | 5/1970 | United Kingdom | 229/27 |

*Primary Examiner*—Joseph Man-Fu Moy
*Attorney, Agent, or Firm*—Evelyn M. Sommer

[57] ABSTRACT

A partitioned carton has front and back panels joined by perpendicular side panels. Each panel has a hinged bottom flap defining a part of the bottom wall of the carton. A first partition panel extends from the middle of the back panel to the middle of the front panel. This panel is about one half the height of the carton with its lower edge being spaced above the bottom wall of the carton. A second partition panel, perpendicular to the first, extends upwardly to the lower edge of the first panel from the bottom flap of the back panel. The second panel has a notch in its upper edge which is received in the lower edge of the first panel to lock the partition panels in place. Each of the bottom flaps is permanently secured to only one of the adjacent bottom flaps. The carton can readily be erected from a collapsed condition without glueing and easily re-collapsed without damage.

16 Claims, 11 Drawing Figures

PARTITIONED CARTON

BACKGROUND OF THE INVENTION

The present invention relates to a carton and more particularly to a carton having transverse partitions that subdivide its interior.

Identical items, such as bottles or glasses or the like, are commonly shipped and marketed in a carton having an interior which is subdivided into a plurality of item-holding compartments. The partition panels that subdivide the interior of the carton separate the items to minimize breakage-causing contact and to prevent shifting of remaining items when one or more of the items is removed. Such a carton is particularly useful when the items being packaged are fragile.

Two main types of partitioned cartons are known. In one common type the interior partitions are completely separate from the exterior carton. Once the exterior carton is erected, the partitions are erected and dropped into place within the carton. An obvious drawback of this type of carton is the extra expense of separately forming the blanks for the cartons and the partitions, erecting both components and then assembling the two.

The second main type of partitioned carton is formed using a single blank which can be erected from a collapsed condition. An example is the traditional six pack beverage wrapper. Known cartons of this type frequently have a bottom wall which is not suitable for supporting heavy loads, particularly when one or more of the items inside the carton has been removed. Furthermore, such cartons are often hard to set up, and once set up, have a tendency to collapse.

SUMMARY OF THE INVENTION

Problems which had accompanied the use of prior art cartons are overcome in an improved carton which is easily erected from a one piece blank to form a partitioned carton having a strong bottom wall and partitions which are "locked" in their erected positions.

A partitioned carton constructed in accordance with the present invention has front and back panels joined by first and second side panels to form a rectangular tube. A bottom flap extends from the lower edge of each of the four side walls of the tube. Each bottom flap is secured to only one of the two adjacent bottom flaps. A first partition panel is connected at the midpoints of the front and back panels. The lower edge of the first partition panel is spaced above the lower edge of panels forming the rectangular tube. A second partition panel, perpendicular to the first partition panel, extends upwardly from one of the bottom flaps. The upper edge of this second partition panel contacts the lower edge of the first partition panel.

BRIEF DESCRIPTION OF THE DRAWINGS

While the specification concludes with claims particularly pointing out and distinctly claiming that which is regarded as the present invention, further details of a preferred embodiment of the invention may be more readily ascertained from the following detailed description when read in conjunction with the accompanying drawings wherein:

DETAILED DESCRIPTION

Figure 1:
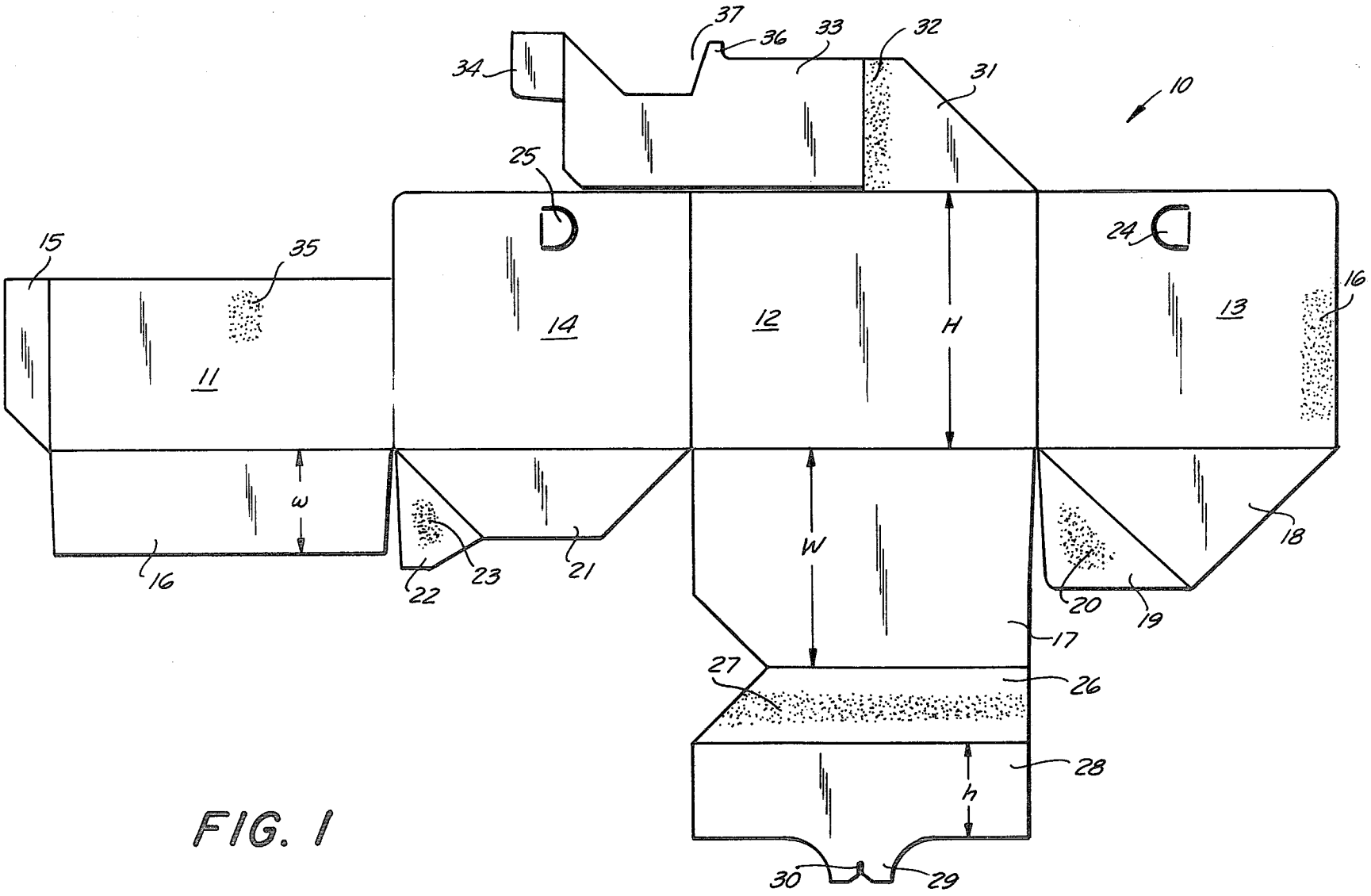
FIG. 1 is a plan view showing a one-piece blank for forming a carton according to the present invention.

Referring to FIG. 1, a carton according to this invention is made from a blank 10 formed from paperboard or a similar, suitable sheet material. The blank has a front panel 11, a back panel 12, a first side panel 13 and a second side panel 14. All of the panels 11–14 are substantially rectangular with the panels 13 and 14 being identical to each other and the front panel 11 being slightly shorter than the other three panels, all of which are the same height. One side edge of front panel 11 is provided with a glue flap 15 which can be adhered to an adhesive strip 16 on the free edge of the side panel 13 to form a rectangular tube.

A bottom flap 16 extends from a fold line at the bottom edge of the front panel 11. This relatively narrow flap has a width w which is substantially less than the transverse width of the side panels 13 and 14. Similarly, another bottom flap extends from a fold line at the lower edge of the back panel 12. Bottom flap 17 is considerably wider than bottom flap 16 with the width W of flap 17 being substantially greater than half the transverse width of the side panels 13 and 14. Side panel 13 is connected to a bottom flap 18 having a generally triangular glue flap 19 with an adhesive coating 20 at one edge. The second side panel 14 similarly has a bottom flap 21 carrying a generally trapezoidal glue flap 22 with an adhesive portion 23. Generally D-shaped tabs 24 and 25 are struck from side panels 13 and 14, respectively, to provide finger holes for use in lifting the finished carton.

A triangular support panel 31 having an adhesive strip 32 at one edge extends from the upper edge of back panel 12. A first partition panel 33 is connected to the support panel 31 at this edge. Partition panel 33 has, at its free edge, a glue tab 34 adapted to be secured to a glue spot 35 on the inner face of the front flap 11. The outer edge of this first partition panel 33 is formed with a short upstanding tab 36 and an adjacent recess 37.

A relatively narrow bridge flap 26 with an adhesive strip 27 extends from the outer edge of the bottom flap 17 to a second partition panel 28 which has an overall height h equal to somewhat less than half of the overall height H of the panels 12, 13 and 14. The free edge of this second partition panel 28 has a central upwardly extending tab 29 with a central notch 30.

Figure 2:
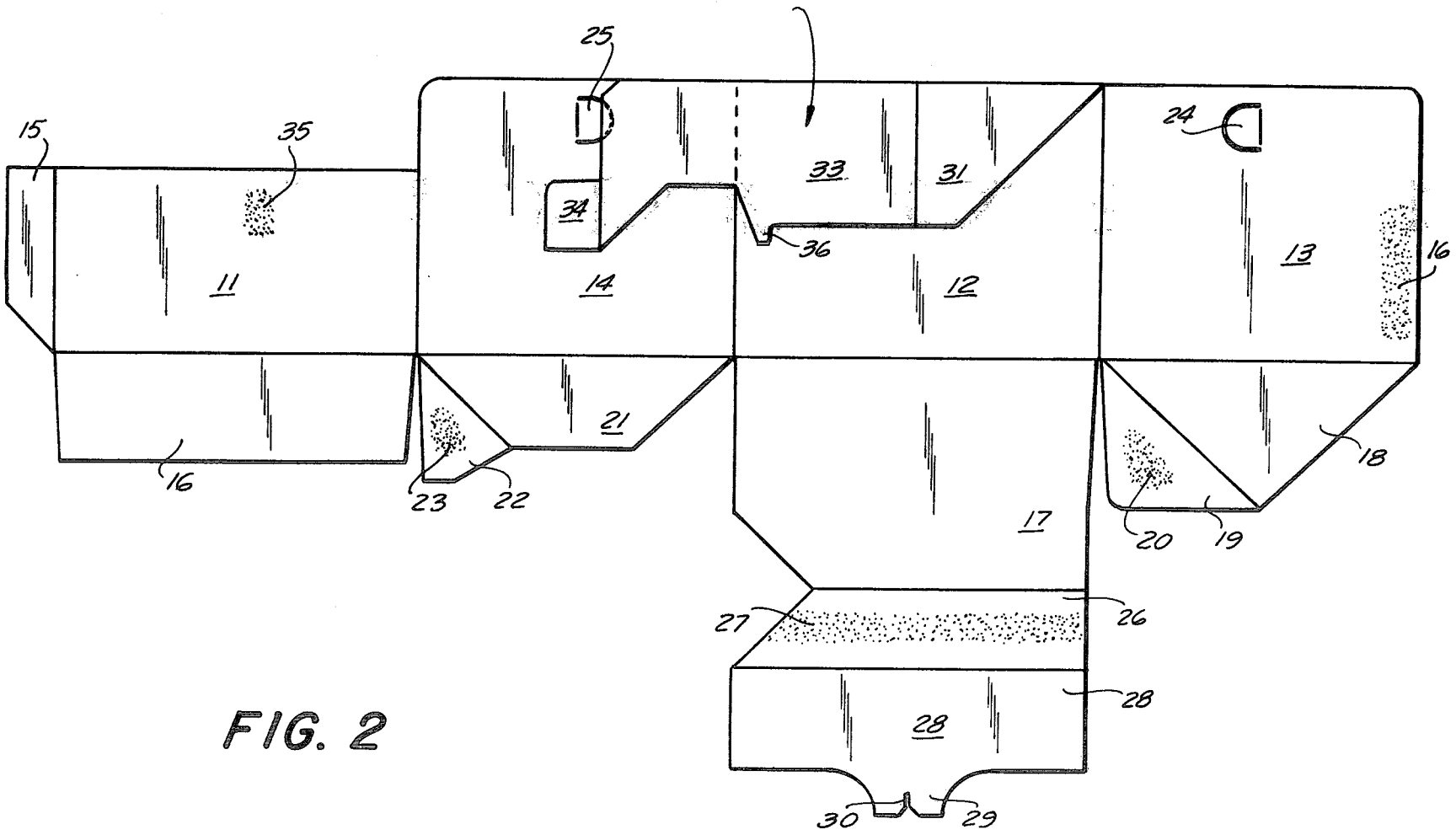
FIGS. 2–6 show sequential folding steps during manufacture of the carton from the blank of FIG. 1.

The first step in fabricating a carton from the above-described blank is shown in FIG. 2. The triangular support panel 31 is folded at the upper edge of front panel 12 to bring panel 31 and the first partition panel 33 into contact with the faces of panels 12 and 14. The adhesive 32 is secured to the inner face of the back panel 12 in this step.

Figure 3:
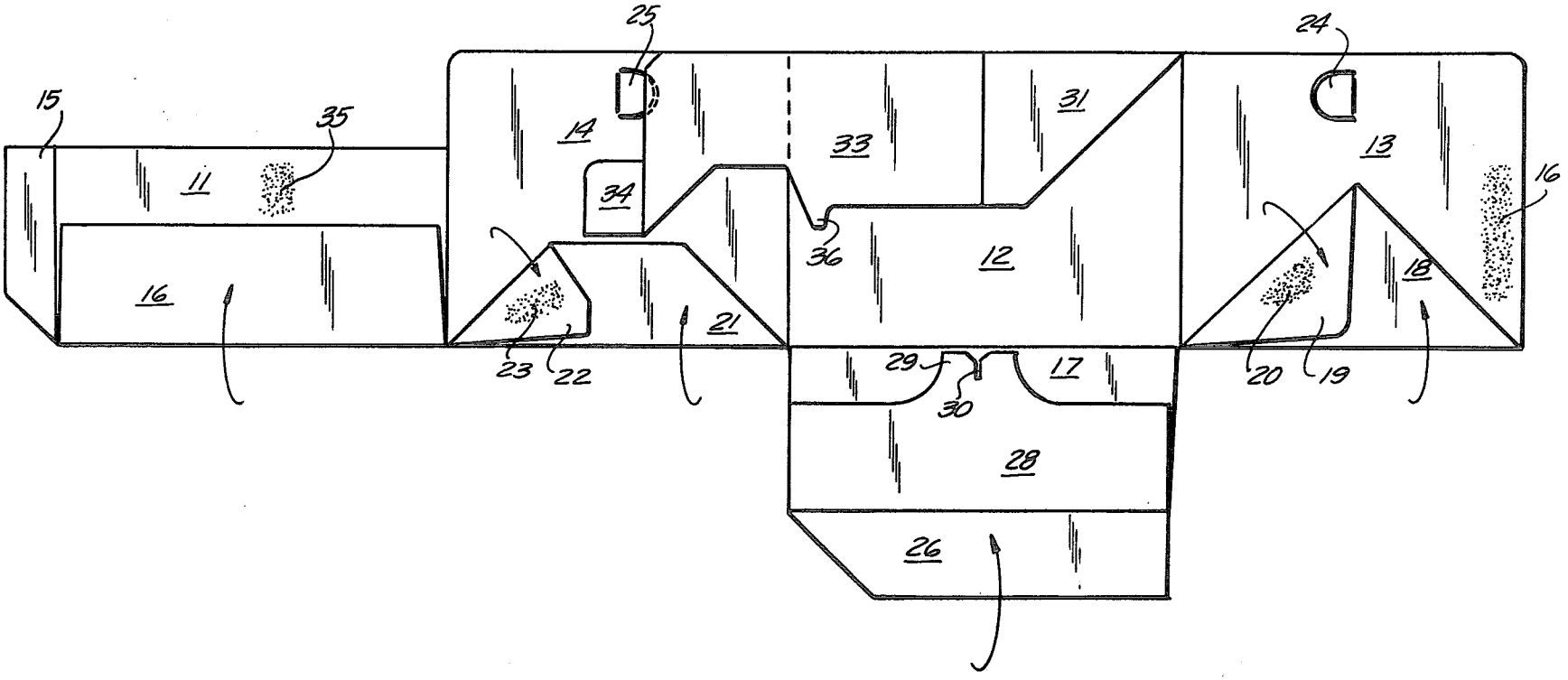

Then, as shown in FIG. 3, the bottom flaps 16, 18 and 21 are folded upward against the inner faces of panels 11, 13 and 14, respectively. The coplanar bridge panel 26 is folded upward at its fold line with bottom flap 17, bringing the adhesive 27 into engagement with the face of the bottom flap 17. When thus folded, triangular cutouts at the left edges of the panels 17 and 26 directly register. The glue flaps 19 and 22 are folded outward or away from panels 13 and 14, respectively, to expose their adhesive coated areas 20 and 23.

Figure 4:
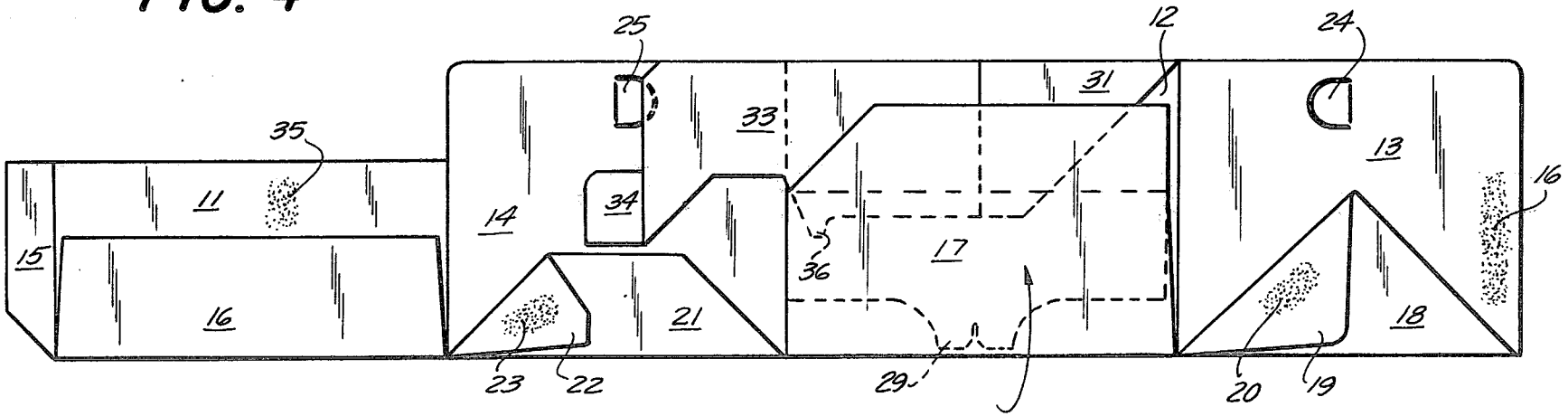

Referring to FIG. 4, bottom flap 17 is folded about the fold line at the lower edge of back panel 12 to sandwich the second partition panel 28 between the bottom flap 17 and back panel 12.

Figure 5:
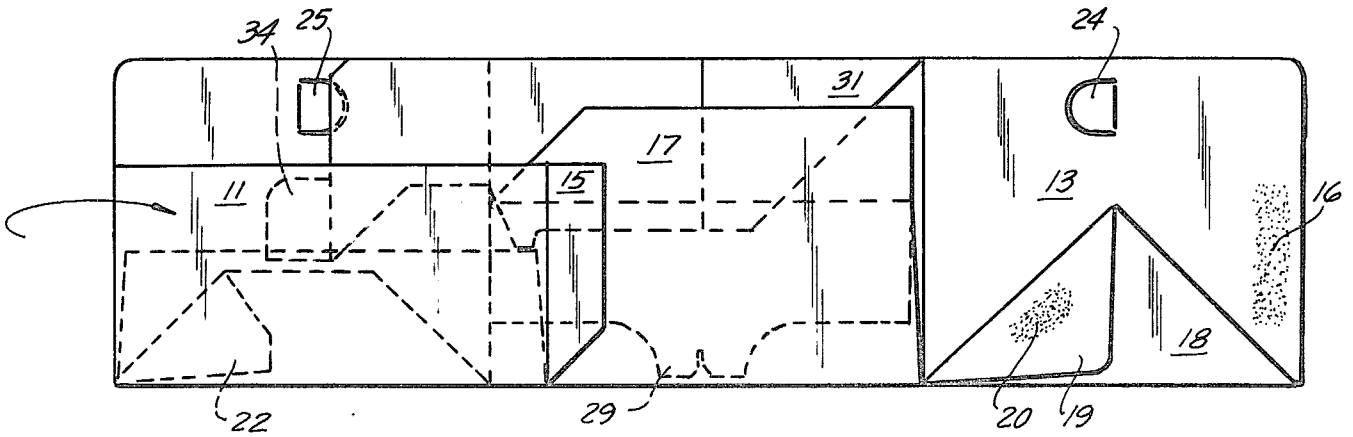

As shown in FIG. 5, front panel 11 with its coplanar glue flap 15 are then folded to the right about the vertical fold line between the panels 11 and 14 so that the bottom flap 16 overlays the bottom flap 21. The adhesive 23 on glue flap 22 secures bottom flap 16 to flap 22. The adhesive 35 on front panel 11 secures that panel to glue tab 34 of the first partition panel 33.

Figure 6:
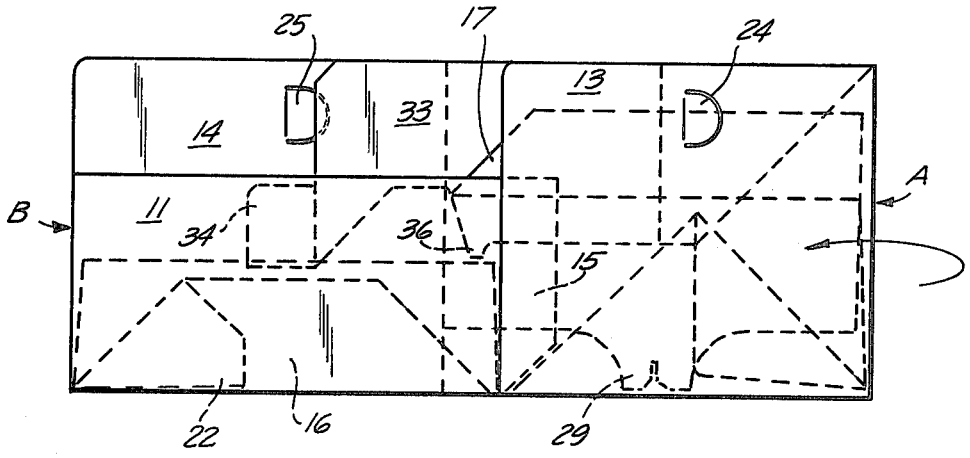

Finally, as shown in FIG. 6, the side panel 13 is folded to the left about the vertical fold line between panels 12 and 13 to bring the adhesive strip 16 on panel 13 into contact with glue flap 15 of front panel 11. At the same time, the adhesive 20 on triangular glue flap 19 secures that flap to one face of the large bottom flap 17.

The carton is typically delivered to the user in this condition. While the carton is collapsed, it can be erected for use without additional glueing.

Figure 7:
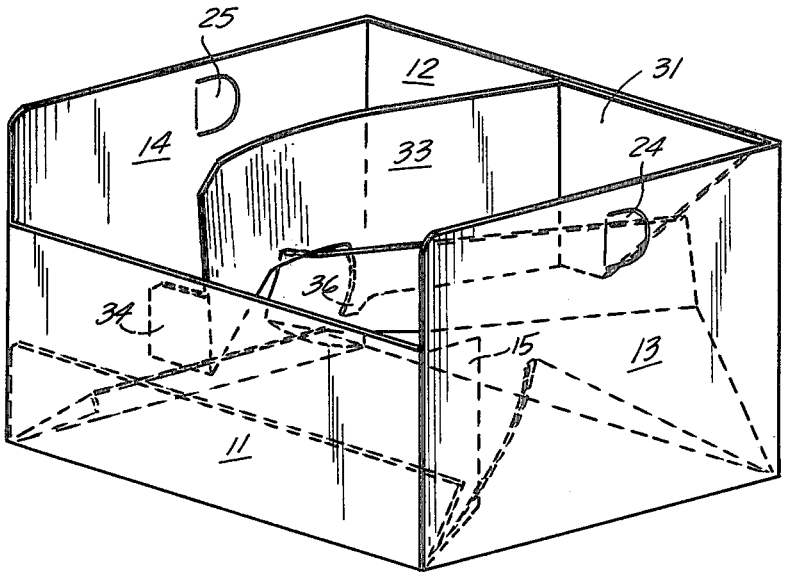
FIG. 7 is a perspective view showing the carton in partially erected condition.

As shown in FIG. 7, a user erects the carton by pulling in opposite directions at the vertical fold lines between panels 12 and 14 and between panels 11 and 13 to spread the side walls of the carton into a rectangular tube configuration. The first pair 16 and 21 and the second pair 17 and 18 of connected bottom flaps are drawn down by the spreading movement to form the floor of the carton. During this step, the bottom flaps 16, 17, 18 and 21 as well as the bridge panel 26 and lower partition panel 28 are all warped somewhat but not to such an extent that the carton material is permanently deformed.

Figure 8:
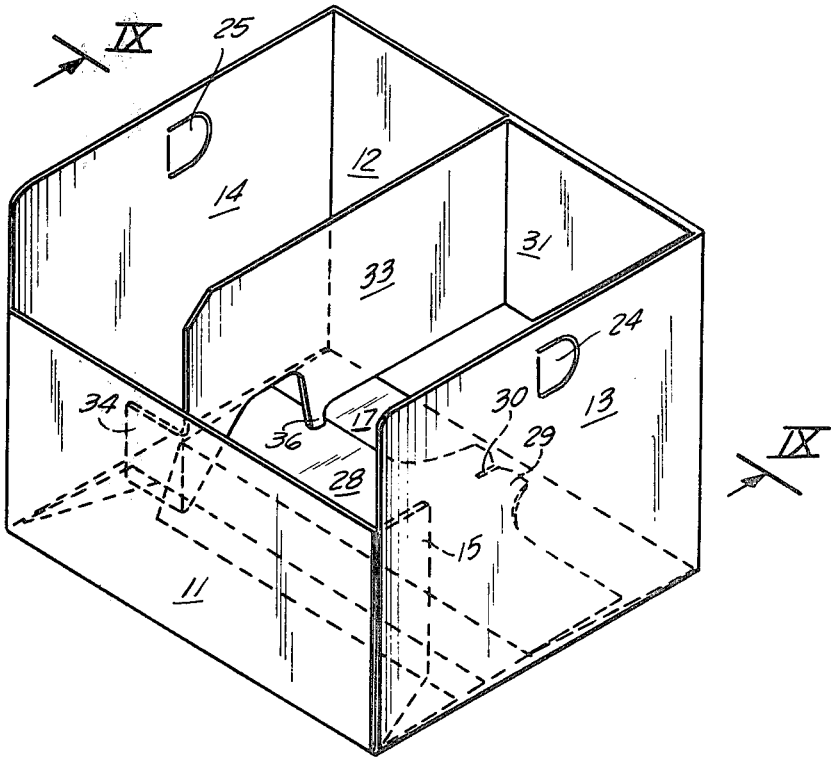
FIG. 8 is a perspective view showing the carton just prior to erection of the second partition panel.
Figure 9:
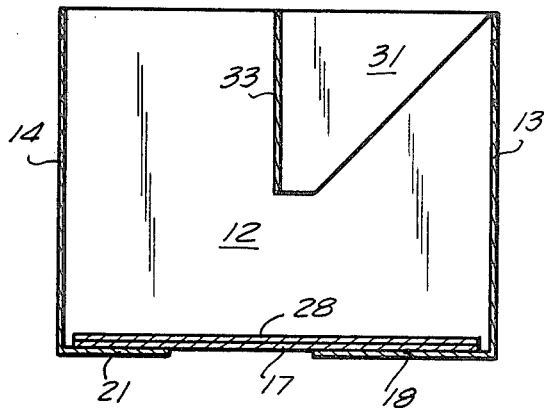
FIG. 9 is a section taken along line IX—IX of FIG. 8.

As shown in FIGS. 8 and 9, the side wall panels 11–14 are squared up, with the first partition panel 13 forming a bridge between the midpoints of the front panel 11 and the back panel 12. The bottom flaps 16, 17, 18 and 21 are all perpendicular to the side walls formed by panels 11–14, with the flaps 18 and 21 being bottom most. Bottom flap 16 is sandwiched between these two flaps and the large flap 17, which forms a substantial portion of the inner floor of the carton.

Figure 10:
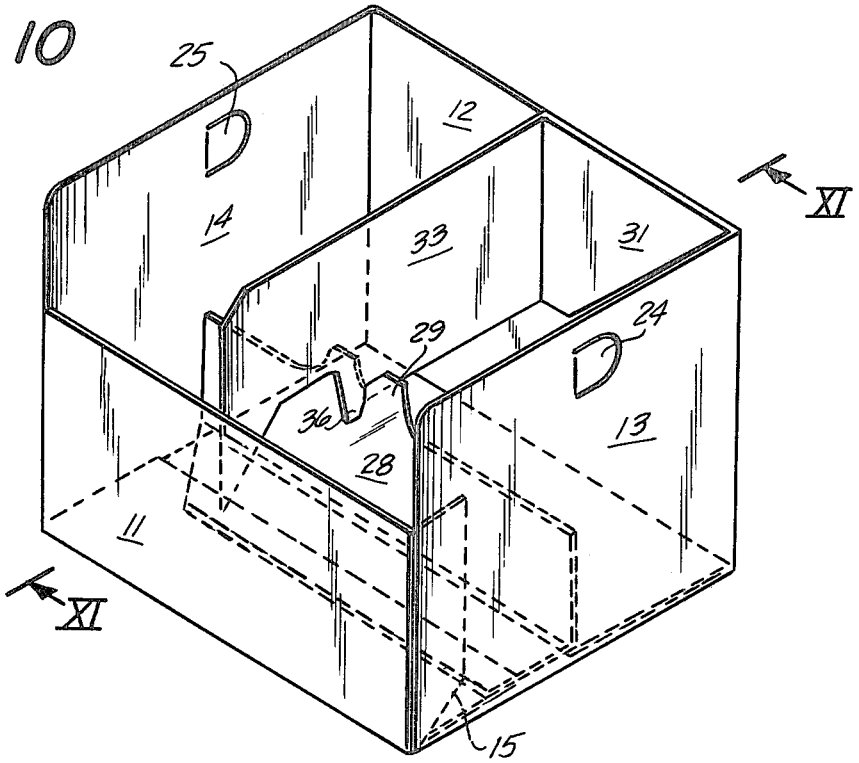
FIG. 10 is a perspective view showing the carton in fully erected condition.
Figure 11:
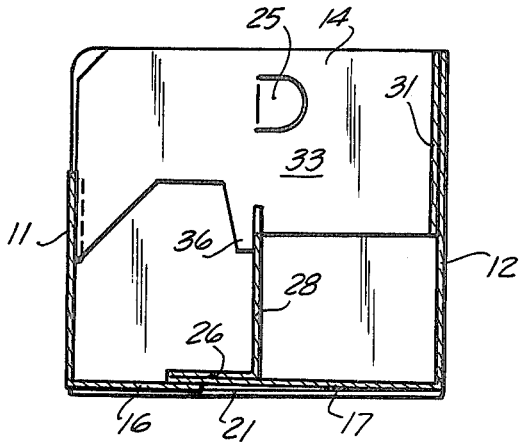
FIG. 11 is a section taken along line XI—XI of FIG. 10.

In the final stage of formation, the second partition panel 28 is pivoted upwardly to a vertical plane. As the panel 28 moves from its initial horizontal position to its final vertical position, tab 29 straddles the lower edge of the first partition panel 33 with the panel material entering the central notch 30. Movement of the partition panel 28 past the vertical position is prevented by tab 36 on panel 33 which bears against one surface of panel 28 when panel 28 reaches a vertical position. The overlapping portions of panels 28 and 33 frictionally lock the panels to help rigidify and strengthen the carton. Tabs 24 and 25 can be pivoted inwardly not only to provide finger holes for handling the carton but also to help position items stored in the four compartments formed by the intersecting partition panels 28 and 33. The fully erected carton is shown in FIGS. 10 and 11.

The carton, when fully erected, is quite rigid and, even when empty, retains its erected shape without any tendency to collapse. The carton can be shipped in collapsed condition, erected without glueing and, if desired, re-collapsed without damage.

It should be pointed out that although use is made here of direction-indicating terms such as "upper" and "lower" as a matter of convenience, these terms are in no way intended to restrict the scope of the invention.

While there has been described what is considered to be a preferred embodiment of the invention, variations and modifications therein will occur to those skilled in the art once they become aware of the basic concepts of the invention. For example, while a preferred embodiment of the invention has only two partition panels, a greater number of panels might be included. Therefore, it is intended that the appended claims shall be construed to cover this and all other variations and modifications as fall within the true spirit and scope of the invention.

What is claimed is:

1. A partitioned carton comprising:

a pair of generally parallel front and back panels;

a pair of generally parallel side panels connecting said front and back panels to form a generally rectangular tube;

bottom flaps extending from the lower edge of each of the above identified panels, said bottom flaps extending along a single plane;

at least one first partition panel having one end secured to said back panel and the opposite end secured to said front panel, said partition panel being parallel to said side panels and having a substantially linear lower edge portion spaced upwardly from the lower edges of said front, back and side panels, said first partition panel including a central tab along said linear lower edge portion projecting downwardly from the linear lower edge portion thereof; and at least one second partition panel extending upwardly from one of said bottom flaps, said second partition panel being perpendicular to said first partition panel and having a tab, with a central notch, projecting inwardly from the top edge thereof to frictionally lock said second partition panel with said first partition panel along its linear lower edge portion, whereby said partition panels subdivide the rectangular tube into a plurality of compartments, the depth of said central notch being less than the extent of the downward projection of said central tab so that said central tab will bear against said second partition panel.

2. The carton defined in claim 1 further including means for securing each bottom flap to only one of the two adjacent bottom flaps.

3. The carton defined in claim 2 wherein said first partition panel is secured to each of said front and back panels at a point midway between the side panels.

4. The carton defined in claim 3 wherein said panels and flaps are formed from a one piece blank.

5. The carton defined in claim 4 further including a support panel securing said first partition panel to said back panel, said support panel being connected to said back panel at the upper edge thereof and to one edge of said first partition panel.

6. The carton defined in claim 5 wherein the bottom flap from which said second partition panel extends is larger than the remaining bottom flaps.

7. The carton defined in claim 6 wherein said second partition panel extends from said bottom flap at a point intermediate the outermost edge of said bottom flap and the lower edge of the panel from which the bottom flap extends.

8. The carton defined in claim 7, wherein the bottom flap carrying said second partition panel extends from the lower edge of said back panel.

9. The carton defined in claim 2 wherein said means for securing each bottom flap to one other bottom flap includes first and second glue flaps extending from different ones of said bottom flaps, each of said glue flaps having an adhesive coating in contact with one of the remaining two bottom flaps.

10. The carton defined in claim 6 wherein the bottom flap from which said second partition panel extends at least partially overlaps each of the remaining bottom flaps of the carton.

11. A blank for a partitioned carton comprising:

a first pair of panels comprising a front panel and a back panel; a first side panel connected to said front and back panels along vertical fold lines at opposite edges thereof; a second side panel connected to said back panel along a vertical fold line at one edge thereof; a support panel connected to one panel of said first pair at an upper edge thereof; a first partition panel connected to said support panel along a vertical fold line at one edge thereof, said first partition panel including a central tab projecting upwardly from an upper linear edge portion thereof; a bottom flap connected to one panel in said first pair at a lower edge thereof; and a second partition panel connected to said bottom flap along a horizontal fold line, said second partition panel including a tab, with a central notch, projecting downwardly from the lower edge thereof.

12. A blank as defined in claim 11 further including a bridge flap interposed between the lower edge of said bottom flap and the upper edge of said second partition panel and being connected to each along horizontal fold lines.

13. A blank as defined in claim 12 wherein each of said first and second partitions has a width equal to approximately one half the height of the back panel.

14. A blank as defined in claim 11 wherein said first partition panel includes a glue tab connected to a side edge thereof along a vertical fold line.

15. A blank as defined in claim 12 further including bottom flaps connected to the lower edges of said first and second side panels and the other panel of said first pair.

16. A blank as defined in claim 15 wherein the bottom flap from which the second partition panel extends is significantly larger than the other bottom flaps.

* * * * *

UNITED STATES PATENT AND TRADEMARK OFFICE

CERTIFICATE OF CORRECTION

PATENT NO. : 4,197,979

DATED : April 15, 1980

INVENTOR(S) : Seymour Hartman

It is certified that error appears in the above-identified patent and that said Letters Patent are hereby corrected as shown below:

Claim 1, line 38, delete "inwardly" and insert in lieu thereof -- upwardly".

Signed and Sealed this

*Twenty-ninth* Day of *July 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,197,979

DATED : April 15, 1980

INVENTOR(S) : Daniel P. Dutcher

It is certified that error appears in the above—identified patent and that said Letters Patent is hereby corrected as shown below:

Claim 1, line 38, delete "inwardly" and insert in lieu thereof -- upwardly --.

This certificate supersedes certificate of correction issued July 29, 1980.

Signed and Sealed this

*Eighteenth* Day of *November 1980*

[SEAL]

*Attest:*

SIDNEY A. DIAMOND

*Attesting Officer*

*Commissioner of Patents and Trademarks*